US006341937B1

(12) United States Patent
Magoshi et al.

(10) Patent No.: US 6,341,937 B1
(45) Date of Patent: Jan. 29, 2002

(54) STEAM TURBINE WITH AN IMPROVED COOLING SYSTEM FOR THE CASING

(75) Inventors: Ryotaro Magoshi; Takashi Nakano, both of Takasago (JP)

(73) Assignee: Mitsubishi Heavy Industries, Ltd. (JP)

( * ) Notice: Subject to any disclaimer, the term of this patent is extended or adjusted under 35 U.S.C. 154(b) by 0 days.

(21) Appl. No.: 09/430,847

(22) Filed: Nov. 1, 1999

(51) Int. Cl.[7] ..... F01D 25/26
(52) U.S. Cl. ..... 415/108; 415/175
(58) Field of Search ..... 415/108, 175, 415/176, 177, 178

(56) References Cited

U.S. PATENT DOCUMENTS 2,796,231 A 6/1957 Hertl
5,149,247 A 9/1992 Gros et al.
5,388,960 A * 2/1995 Suzuki et al. ..... 415/176

FOREIGN PATENT DOCUMENTS

EP 0-926-316 A1 6/1999

* cited by examiner

*Primary Examiner*—Edward K. Look
*Assistant Examiner*—James M McAleenan
(74) *Attorney, Agent, or Firm*—Wallenstein & Wagner, Ltd.

(57) ABSTRACT

A steam turbine includes a rotor which extends along a longitudinal axis and having at least two different pressure turbine portions disposed around and along the rotor. Each of the turbine portions has multiple stages. A casing encloses the rotor and has at least one steam inlet. A dummy ring is provided stationarily around the rotor to separate and seal between the two different pressure turbine portions. The dummy ring defines nozzle chamber for receiving the steam from the steam inlet port and a plurality of nozzles for directing the steam from the nozzle chamber toward the higher pressure turbine portion. The dummy ring and the casing define a space therebetween. The space is fluidly connected to the higher pressure turbine portion. A steam passage extends between the space and a steam passage downstream of the last stage of the higher pressure turbine portion. The steam passage allows the steam within the space to flow to the steam passage downstream of the last stage of the higher pressure turbine portion to cool the casing.

3 Claims, 3 Drawing Sheets

STEAM TURBINE WITH AN IMPROVED COOLING SYSTEM FOR THE CASING

BACKGROUND OF THE INVENTION

1. Field of the Invention

The invention relates to a steam turbine and, in particular, to a steam turbine with an improved cooling system for the casing.

2. Description of the Related Art

With reference to FIG. 3, a prior art stream turbine includes a rotor 100 extending along a longitudinal axis, and a casing 102 enclosing the rotor 100. A high pressure turbine portion 103, an intermediate pressure turbine portion 104 and a lower pressure turbine portion 105 are disposed within the single casing 102 around and along the rotor 100.

Provided within the casing 102 is a dummy ring 110 which separates the high and intermediate pressure turbine portions 103 and 104 and seals therebetween. The dummy ring 110 and the casing 101 define a space 118 therebetween. The space 118 is filled with steam so that the steam within the space 118 is held there. The steam within the space 118 is heated by thermal transfer from the high pressure and temperature steam supplied to the high pressure turbine portion 103 so that the portion of the casing 102 enclosing the space 118 is also heated. This results in the thermal deformation of the casing 102.

SUMMARY OF THE INVENTION

The invention is directed to solve the above mentioned prior art problems, and the objective of the invention is to provide a steam turbine with an improved cooling system for the casing.

The invention provides a steam turbine which includes a rotor which extends along a longitudinal axis and has at least two different pressure turbine portions disposed around and along the rotor. Each of the turbine portions has multiple stages. A casing encloses the rotor and has at least one steam inlet. A dummy ring is provided stationarily around the rotor to separate and seal between the two different pressure turbine portions. The dummy ring defines a nozzle chamber for receiving the steam from the steam inlet port and a plurality of nozzles for directing the steam from the nozzle chamber toward the higher pressure turbine portion. The dummy ring and the casing define a space therebetween. The space is fluidly connected to the higher pressure turbine portion. Piping extends between the space and a steam passage downstream of the last stage of the higher pressure turbine portion. The steam passage allows the steam within the space to flow to the steam passage downstream of the last stage of the higher pressure turbine portion to cool the casing.

DESCRIPTION OF THE DRAWINGS

These and other objects and advantages and a further description will now be discussed in connection with the drawings in which.

DESCRIPTION OF THE PREFERRED EMBODIMENTS

Figure 1:
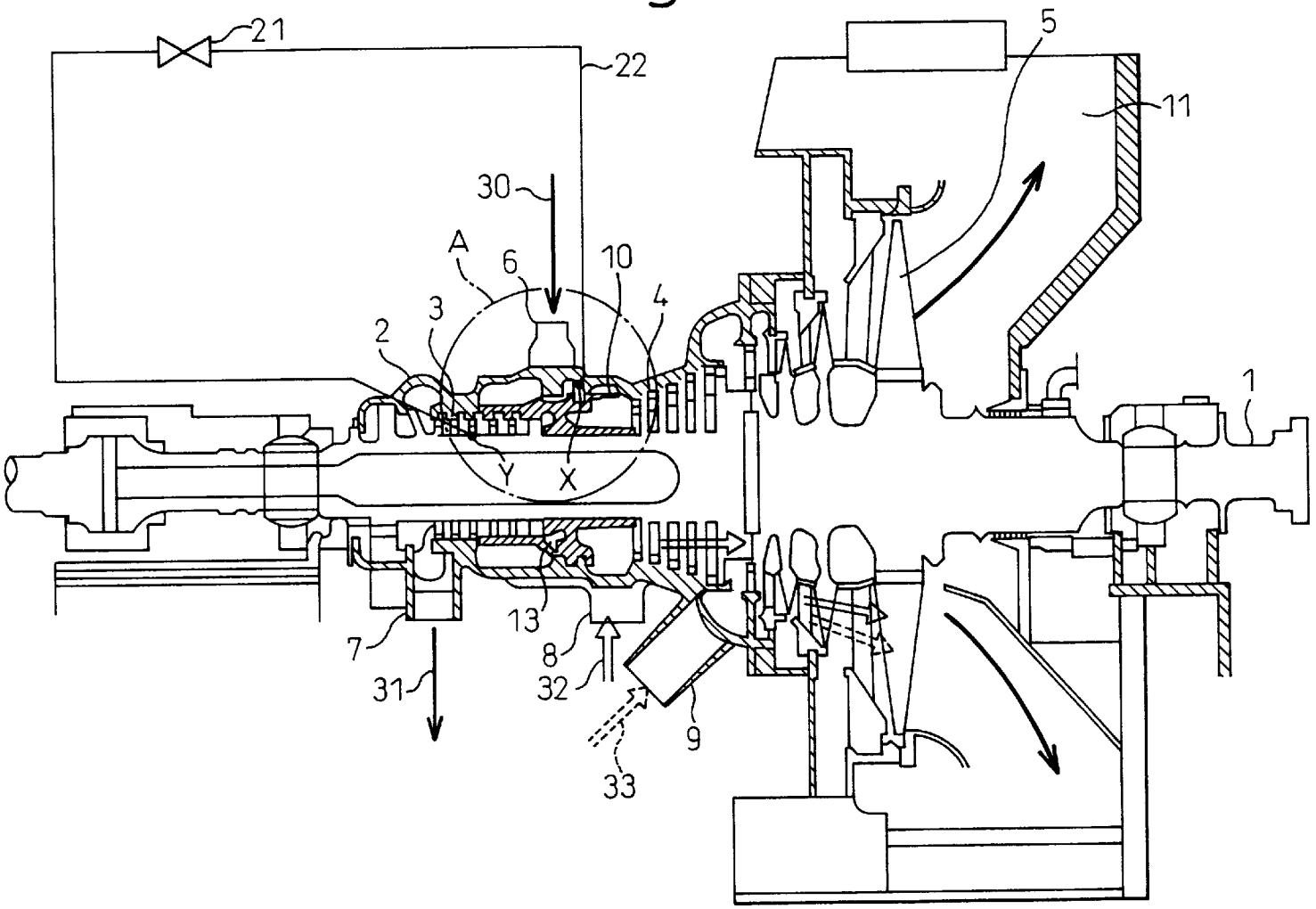
FIG. 1 is a generally sectional view of a steam turbine according to the preferred embodiment of the invention.
Figure 2:
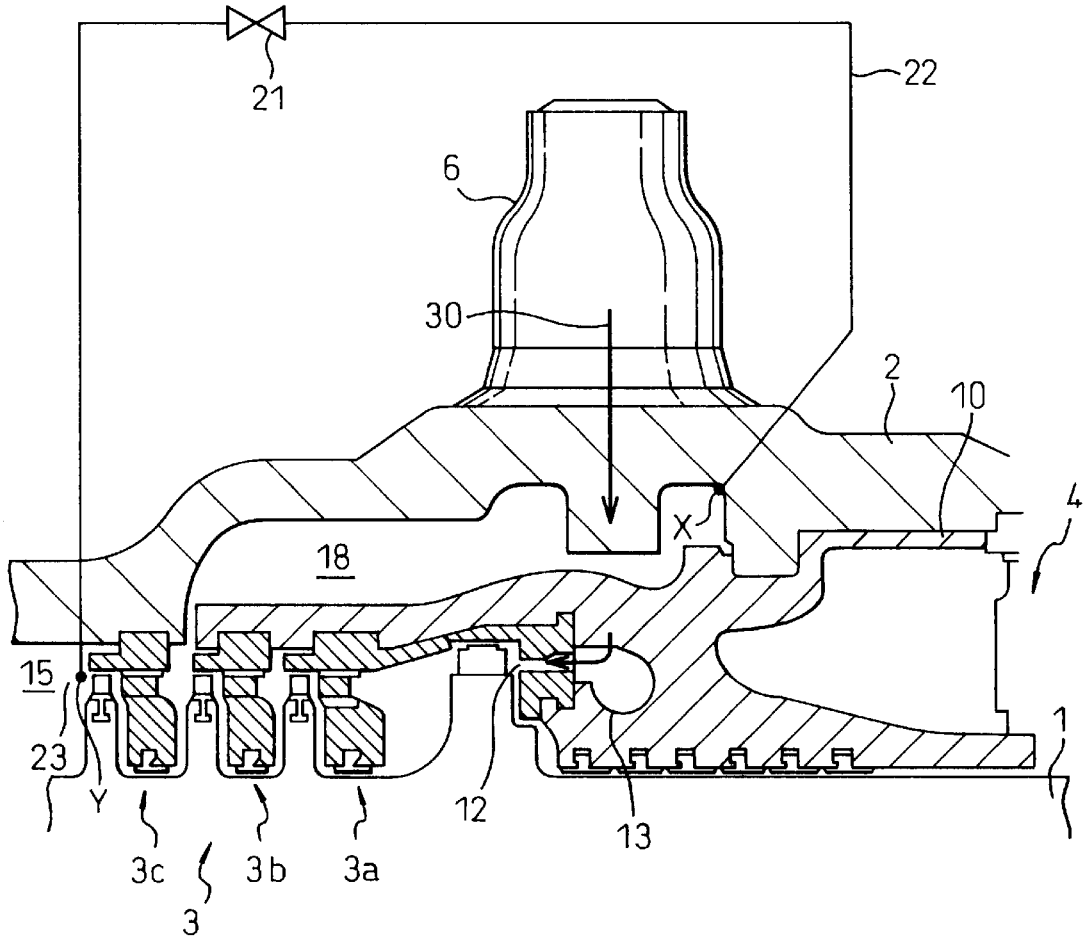
FIG. 2 is an enlarged section illustrating in detail a portion of the steam turbine indicated by "A" in FIG. 1.
Figure 3:
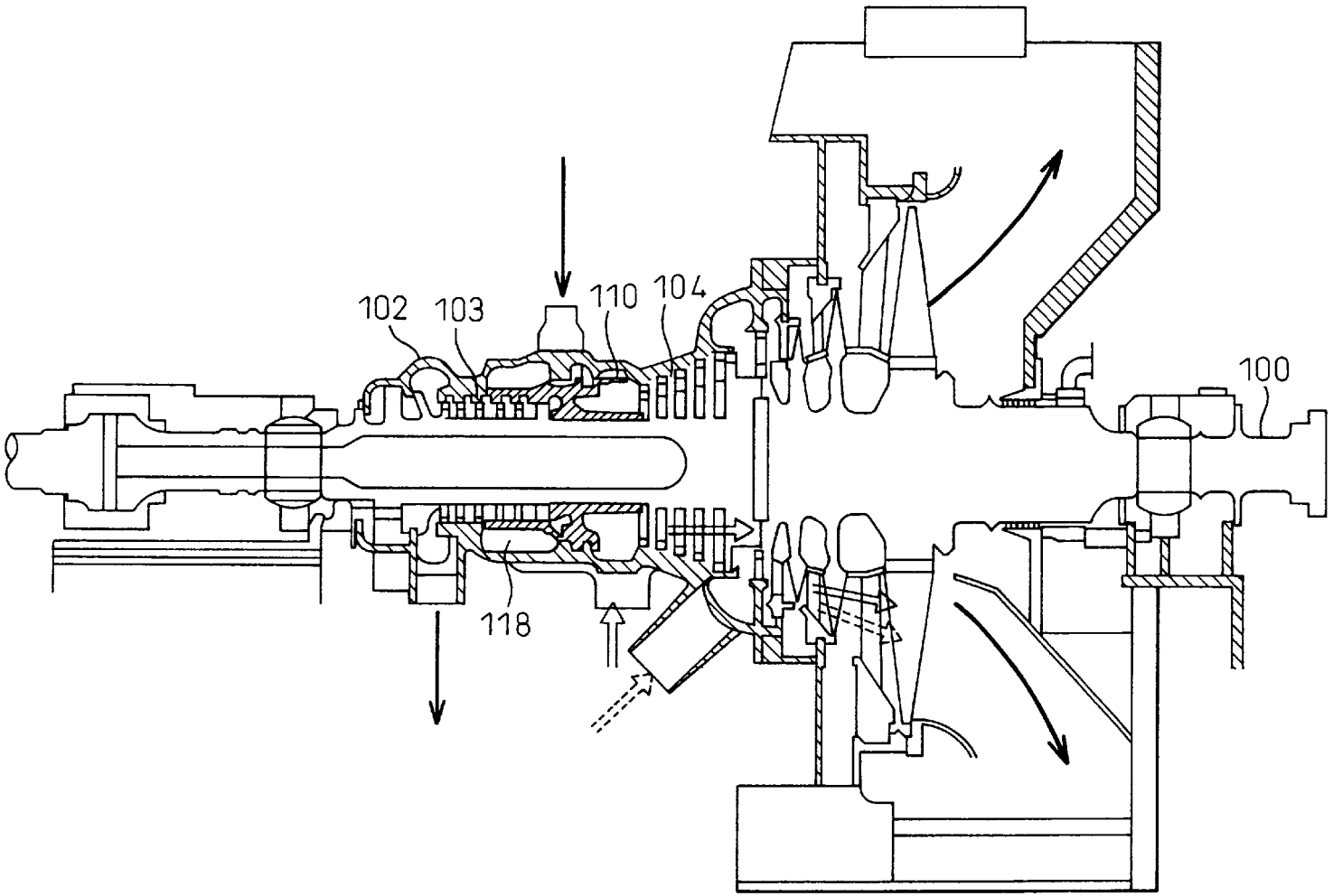
FIG. 3 is a generally sectional view of a steam turbine of the prior art.

With reference to FIGS. 1 and 2, the preferred embodiment of the invention will be described.

FIG. 1 shows a sectional view of a stream turbine according to the preferred embodiment of the invention which includes a rotor 1 extending along a longitudinal axis and a casing 2 for enclosing the rotor 1. A high pressure turbine portion 3, an intermediate pressure turbine portion 4 and a low pressure turbine portion 5 are disposed within the single casing 2 around and along the rotor 1. In this particular embodiment, the high pressure turbine portion 3 includes first, second and third stages 3*a*, 3*b* and 3*c* which are provided around and along the rotor 1 (FIG. 2). Although it is not shown in detail in the drawings, the casing 2 includes higher and lower shell halves which are joined to each other at a horizontal plane by a plurality of bolts, as is well-known in the art.

The casing 2 includes a high pressure steam inlet port 6 through which high pressure steam 30 is supplied to the high pressure turbine portion 3 and a high pressure steam outlet port 7 through which the steam used in the high pressure turbine 3 is exhausted from the high pressure turbine portion 3. The casing 2 further includes an intermediate pressure steam inlet port 8 through which an intermediate pressure steam 32 is supplied to the intermediate pressure turbine portion 4. The casing 2 further includes a low pressure steam inlet port 9 through which a low pressure steam 33 is supplied to the low pressure turbine portion 5. Provided within the casing 2 is a dummy ring 10 which separates the high and intermediate pressure turbine portions 3 and 4 and seals therebetween (FIG. 2).

The high pressure steam 30 flows into the high pressure turbine portion 3 through the high pressure steam inlet port 6 to drive the high pressure turbine portion 3, after which the steam used in the high pressure turbine portion is exhausted through the high pressure steam outlet port 7. The intermediate pressure steam 32 flows into the intermediate pressure turbine portion 4 through the intermediate steam inlet port 8 to drive the intermediate pressure turbine portion 4, after which it flows into the low pressure turbine portion. The low pressure steam 33, supplied through the low pressure steam inlet port 9, flows into the low pressure turbine portion 5 together with the steam from the intermediate pressure turbine portion 4 to drive the low pressure turbine portion 5. The steam used in the low pressure turbine portion 5 is exhausted through an exhaust chamber 11.

The casing 2 and the dummy ring 10 define a space 18 therebetween. The space 18 is fluidly connected to the high pressure steam turbine portion 3 at a portion between the second and third stages 3*b* and 3*c* through a gap. Therefore, the space 18 is filled with steam from downstream of the second and third stage 3*b* through gap. However, in the prior art, the space 18 is not fluidly connected to another portion within the casing 2 so that the steam within the space 18 is held there.

The casing 1 and the dummy ring 10 define a space 18 therebetween. The space 18 is fluidly connected to the high pressure steam turbine portion 3 at a portion between the second and third stages 3*b* and 3*c* through a gap 16. Therefore, the space 18 is filled with steam from downstream of the second and third stage 3*b* through gap 16. However, in the prior art, the space 18 is not fluidly connected another portion within the casing 2 so that the steam within the space 18 is held there.

The steam within the space 18 is heated to at least 500° C. by thermal transfer from the high temperature steam within the nozzle chamber 13 and between the nozzles 12 and the first stage 3*a* through the dummy ring 10. The heated steam within the space 18 then heats the portion of the casing 2 enclosing the space 18 to at least 500° C. This results in the thermal deformation of the casing 2 and the increase in the stress in the bolts connecting the upper and lower shell halves of the casing 2.

The embodiment shown in FIG. 2 includes external piping or a steam passage 22 extending between the space 18 and a steam passage 15 downstream of the third stage 3*c* of the high pressure turbine portion 3. The steam passage 15 is fluidly connected to the high pressure steam outlet port 7. The external piping 22 allows the steam within the space 18 to flow to the steam passage 15 and establishes a steam flow passage, for cooling the casing Z from the high pressure turbine portion 3 between the second and third stages 3*b* and 3, through the gap, the space 18, and the external piping 22 to the steam passage 15 downstream of the third stage 3*c* of the high pressure turbine portion 3. The expansion of the steam through the first and second stages 3*a* and 3*b* of the high pressure turbine portion 3 reduces its temperature from approximately 500° C. to approximately 450° C. This reduces the temperature of the casing 2 whereby the amount of the thermal deformation of the casing 2 and the stress in the bolts for connecting the upper and lower shell halves of the case 2, are reduced.

The external piping 22 may includes a valve 21 for controlling the flow rate of the steam through the piping 22. Controlling the flow rate of the steam controls the overall heat influx to the casing 2 and thus controls the temperature of the casing 2.

It will also be understood, by those skilled in the art, that the forgoing description is a preferred embodiment of the disclosed invention and that various changes and modifications may be made without departing from the spirit and scope of the invention.

We claim:

1. A steam turbine comprising:

a rotor extending along a longitudinal axis and having at least two different pressure turbine portions disposed around and along the rotor, each of which has multiple stages;

a casing for enclosing the rotor, the casing including at least one steam inlet;

a dummy ring, provided stationarily around the rotor, for separating and sealing between the two different pressure turbine portions, the dummy ring defining a nozzle chamber for receiving the steam from the steam inlet port and a plurality of nozzles for directing the steam from the nozzle chamber toward the higher pressure turbine portion, the dummy ring and the casing defining a space therebetween, the space being fluidly connected to the higher pressure turbine portion;

a first steam passage, extending between the space and a second steam passage downstream of the last stage of the higher pressure turbine portion, for allowing the steam within the space to flow to the second steam passage downstream of the last stage of the higher pressure turbine portion to cool the casing.

2. A steam turbine according to claim 1, wherein the first steam passage includes a valve for controlling the flow rate of the steam through the steam passage to control the cooling of the casing.

3. A steam turbine according to claim 1 the high pressure turbine portion including at least three stages, and the space being fluidly connected between the second and third stages.

* * * * *